US008795468B2

(12) United States Patent
Saetherasen et al.

(10) Patent No.: US 8,795,468 B2
(45) Date of Patent: Aug. 5, 2014

(54) METHOD AND SYSTEM FOR IMPREGNATING CHIPS

(75) Inventors: Jonas Saetherasen, Hammaro (SE); Kent-Olof Karlsson, Karlstad (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 13/808,962

(22) PCT Filed: Jul. 9, 2010

(86) PCT No.: PCT/SE2010/050799

§ 371 (c)(1),
(2), (4) Date: Jan. 8, 2013

(87) PCT Pub. No.: WO2012/005643

PCT Pub. Date: Jan. 12, 2012

(65) Prior Publication Data

US 2013/0105098 A1 May 2, 2013

(51) Int. Cl.

| | |
|---|---|
| ***D21C 1/02*** | (2006.01) |
| ***D21C 1/06*** | (2006.01) |
| ***D21C 7/00*** | (2006.01) |
| ***D21C 3/24*** | (2006.01) |

(52) U.S. Cl.

CPC .. *D21C 1/02* (2013.01); *D21C 7/00* (2013.01); *D21C 3/24* (2013.01)

USPC ..... 162/41

(58) Field of Classification Search

CPC ..... D21C 1/02; D21C 1/06; D21C 7/00; D21C 7/10; D21C 7/12

USPC ..... 162/41

See application file for complete search history.

(56) References Cited

U.S. PATENT DOCUMENTS

| | | | | |
|---|---|---|---|---|
| 3,573,157 | A * | 3/1971 | Cook | 162/19 |
| 4,028,171 | A * | 6/1977 | Richter | 162/19 |
| 4,193,839 | A * | 3/1980 | Sherman | 162/19 |
| 5,660,686 | A * | 8/1997 | Henricson et al. | 162/41 |
| 6,123,808 | A | 9/2000 | Bechard | |
| 7,381,302 | B2 | 6/2008 | Snekkenes | |
| 7,615,134 | B2 * | 11/2009 | Snekkenes et al. | 162/17 |
| 8,647,469 | B2 * | 2/2014 | Trolin et al. | 162/17 |
| 2009/0020244 | A1 * | 1/2009 | Stromberg | 162/17 |
| 2011/0203755 | A1 * | 8/2011 | Saetherasen | 162/45 |
| 2013/0240167 | A1 * | 9/2013 | Trolin et al. | 162/17 |

FOREIGN PATENT DOCUMENTS

| | | |
|---|---|---|
| FI | WO2005106111 | 11/2005 |
| SE | WO2006006934 | 1/2006 |
| SE | WO2010044732 | 4/2010 |

* cited by examiner

*Primary Examiner* — Anthony Calandra

(74) *Attorney, Agent, or Firm* — Rolf Fasth; Fasth Law Offices

(57) ABSTRACT

The withdrawal screen section is for impregnation of chips during the manufacture of chemical pulp. Chips are steamed and impregnated in a low pressure impregnation vessel using pressurized hot spent cooking liquor BL. The spent cooking liquor produces most of the steam $BL_{ST}$ necessary for steaming the chips. To reduce the need for adding fresh steam for chip steaming is a first withdrawal section in the impregnation vessel modified to be used both as a flash tank for warm pressurized wash filtrate and improved wash-out feature for the spent impregnation liquid behind the screen in the withdrawal section. The withdrawal volume is arranged with an upper part located above the liquid level $LIQ_{LEV}$ of the impregnation vessel. Additional pressurized warm wash liquor $REC_1$ is added to the withdrawal volume and flashed off steam is led in a steam duct to the chip volume above the liquid level.

8 Claims, 5 Drawing Sheets

METHOD AND SYSTEM FOR IMPREGNATING CHIPS

PRIOR APPLICATION

This application is a U.S. national phase application that is based on and claims priority from International Application No. PCT/SE2010/050799, filed 9 Jul. 2010.

TECHNICAL FIELD

The present invention concerns impregnation of chips during the manufacture of chemical pulp.

BACKGROUND AND SUMMARY OF THE INVENTION

In conventional continuous cooking has a pre-treatment arrangement with a chip bin been used, in which a first heating of the chips by low pressure steam to a temperature of 70-80° C. is carried out. A steam-treatment in a steam vessel follows the pre-treatment in which the chips are intensely heated with high pressure steam to 110-120° C. The thoroughly steamed chips are then slurried in a chip chute before being fed to the cooking process. This process requires large quantities of steam as well a number of expensive treatment vessels adding cost and complexity into the cooking system.

The extensive steam treatment and its implementation in several treatment vessels has been considered to be totally necessary in order to be able ensure that air and water bound to the chips are expelled, such that the impregnation fluid can fully penetrate the chips and such that air is not drawn into the digestion process with the chips.

Attempts have been made to integrate the chip bin with the impregnation vessel such that a simple system is in this way obtained.

Metso Fiber Karlstad AB's U.S. Pat. No. 3,532,594 shows a combined vessel in which steam treatment and the formation of a slurry take place in a single pressure vessel that is maintained at an excess pressure of 1-2 atmospheres. The system was used in a pulp plant in Sweden as early as the 1970s. In this case, an impregnation fluid is recirculated during the addition of black liquor that maintains the suggested temperature of 105° C. in a circulation that consists of withdrawal strainer (35)-pump (23)-heat exchanger (25)-outlet/central pipe (27). Steam flashed off from black liquor in a flash tank was also added in an additional central pipe together with an optional addition of fresh steam. The idea in this case was that all water vapour would be expelled through the superior bed of chips by steam, and that this water vapour could be withdrawn (ventilated) through the outlet 12. A powerful heat exchanger (25) was required in this system. There is a serious risk of malodorous non-condensable gases (NCGs) leaking out, via the inlet 13. It is also specified in this patent that it would be possible to remove totally the addition of steam and have only a reinforced indirect heating of the chips with the aid of a heating flow during the addition of black liquor. It is difficult to implement this heating technology since it requires very large recirculation flows and a large heating power in the heat exchanger in order to be able to heat the cold chips.

U.S. Pat. No. 5,635,025 shows a system in which chips are fed without a preceding steam treatment into a vessel in the form of a combined chip bin, impregnation vessel and chip chute. Steam treatment of the chips that lie above the fluid level takes place at this location by the addition of steam from a "steam source", as does a simple addition of impregnation fluid in the lower part of the vessel.

U.S. Pat. No. 6,280,567 shows a further such system in which the chips are fed without preceding steam treatment into an impregnation vessel at atmospheric pressure where the chips are heated by the addition of hot black liquor that maintains a temperature of approximately 130-140° C. The hot black liquor is added just under the fluid level via pipes in the wall of the impregnation vessel and excess liquid is only drained from the slurry in an external steaming vessel.

SE 523850 shows an alternative system in which hot, pressurized black liquor taken directly from the digester at a temperature of 125-140° C. is added to the upper part of the steam-treatment vessel, above the fluid level but under the level of chips, whereby the black liquor whose pressure has been relieved releases large quantities of steam for the steam treatment of the chips that lie above the fluid level established in the vessel. A temperature between 140-160° C. is established in the impregnation vessel in this system. Excess fluid, the black liquor, can in this case be withdrawn from the lower part of the vessel.

Thus, prior art technology has in most cases used steam treatment as a significant part of the heating of the chips, where the steam that is used is either constituted by fresh steam or by steam that has been obtained following pressure reduction of black liquor from the cooking step, the latter containing large amount of sulphur laden NCG gases. This ensures a relatively large flow of steam, with the associated consumption of energy, and it requires a steam-treatment system that can be controlled.

The steam treatment has also involved the generation of large quantities of malodorous gases, i.e. NCG gases, with a high risk of explosion at certain concentrations.

U.S. Pat. No. 7,381,302 (or U.S. Pat. No. 7,615,134) shows an arrangement in an attempt to avoid excessive volumes of steam flowing trough the chip bed. Impregnation fluids (BL1/BL2/BL3) are in this case added with increasing temperatures at different positions (P1, P2, P3) where the local pressure may be above the boiling point of the added liquor. Most of the volatile compounds in the black liquor added are bound to the withdrawn impregnation fluid (REC).

In SE 530725 (=US2009139671) is a further improvement of atmospheric impregnation vessels using hot black liquor shown. Here are knock down showers installed above the chip level in order to prevent blow trough of malodorous NCG gases.

From continuous digester it is also known to flush out the withdrawal space in withdrawal screen sections using recirculation of the liquid withdrawn, and in WO2010/044732 is one such system shown where a chemical is added in order to prevent precipitation in the liquid withdrawn.

It has surprisingly become apparent that the use of an atmospheric impregnation vessel, using hot alkaline black liquor for the major part of the steaming effect of chips, releases large quantities of wood acidity in the chips. In recent tests in impregnation of chips has as much as 1.5 $m^3$ of acidic liquid with no or neglect able residual alkali been withdrawn from early screen sections in the impregnation vessel. There are a number of possible cures for this situation, but most of them results in increased alkali losses in the withdrawn spent impregnation liquid. A problem associated with acidity in the withdrawn spent impregnation liquid is that the liquid is likely to form stagnant lignin precipitates that clog up the screen section.

Another problem is that the addition of hot black liquor, even if it holds the same temperature as the full cooking temperature and is added as the major part of liquid forming the necessary liquid-to-wood ratio, do not produce all of the steam needed for steaming the chips in the volume located above the liquid level. Most often is additional fresh steam from the steam net in the pulp mill added which of course results in energy losses and lack of profits from not using the steam in production of electricity in steam driven turbines. There is a great interest from pulp mill operators to reduce the steam consumption needed for cooking pulp.

The principal aim of the present invention is to achieve an improved method and an improved system for the impregnation and heating of chips that have not been steam-treated, which method and system reduce the problems with stagnant volumes of lignin precipitate in screen sections while at the same time considerable volumes of steam for chip steaming is released.

A second aim is to reduce the steam consumption for impregnation and cooking, obtaining a more energy efficient process, which is done by utilizing waste liquid flows with a residual heat value that normally is not high enough for motivating investments in heat recovery systems in the impregnation and cooking process.

A third aim in a preferred embodiment is to use a waste liquid flow from the digester that still have a residual alkali level, that could be used to increase the pH in the withdrawal volume of the screen section. The increase of pH would thus impede the formation of lignin precipitate, and this without affecting the impregnation process as such as this waste liquid flow is not exposing the chips to be impregnated.

The inventive method for the impregnation of chips during the manufacture of chemical pulp comprises following steps;

a) chips are continuously fed without preceding steam treatment to the top of an impregnation vessel where impregnated chips are fed out from the bottom of the vessel,
b) hot impregnation fluid at a first temperature above the boiling point of the hot impregnation fluid is added to the impregnation vessel via a pipe having the outlet end located below a chip level established in the impregnation vessel and at a distance from the walls of the impregnation vessel, preferably in the centre, such that steam is released into the chip volume for steaming the chips,
c) the impregnation fluid added establishes a fluid level in the impregnation vessel and where the chip level lies at least 1-2 meters, preferably 3-5 meters, over the fluid level and where the pressure at the top of the impregnation vessel that is essentially at the level of atmospheric pressure, ±0.5 bar preferably ±0.2 bar,
d) that a withdrawal of spent impregnation fluid for recovery takes place from the vessel at the level of the fluid level, from a withdrawal volume located behind screens mounted in the wall of the impregnation vessel, and finally in that an additional fluid (WL) at a second temperature above the boiling point of the additional fluid is added into the withdrawal volume and which release steam into the withdrawal volume, which steam is lead in towards the chips below the chip level for steaming the chips.

The additional fluid with a temperature above the boiling point in the withdrawal volume would then use the withdrawal volume as a flash tank, and release steam from the residual heat value of the additional fluid. This steam will then be used to steam the chips thus reducing the need for any complementary addition of fresh steam. The pressure reduced additional fluid, at a temperature close to boiling point, is then led to the withdrawal volume and will increase the flow speed of the standing liquid volume therein, if the same net withdrawal volume is withdrawn from the chips via the screen.

In a further preferred embodiment of the inventive method is the amount of hot impregnation fluid fed in to the impregnation vessel in association with the fluid level exceeding 5 tonnes per tonne of wood and at a temperature of the impregnation fluid in the interval 115-150° C., such that the temperature of the fluid-wood mixture that is established at the fluid level is established within the interval 90-115° C., preferably within the interval 95-105° C., and where the level of alkali of the added impregnation fluid exceeds 15 g/l.

The volume and temperature of the hot impregnation liquid added will then produce the major part of the steam necessary for steaming the chips. The residual alkali level would then also add the necessary alkali for the impregnation process that consumes a large part of the alkali in the total cooking process. 5 tonnes of liquid with a residual alkali level of 15 g/l will introduce 75 kg of alkali per ton of wood, whish is almost the half part of the total alkali consumption for a typical kraft cook which lies at a level of some 170-190 kg of alkali per ton of wood.

In a preferred embodiment of the inventive method is the temperature of the additional fluid fed into the withdrawal volume behind the screens in the impregnation vessel exceeding the boiling point of the additional fluid in the withdrawal volume by at least 5° C., and that the amount of additional fluid fed into the withdrawal volume results in an amount of steam released exceeding at least 5 ton of steam per hour, and where the level of alkali of the added additional fluid exceeds 2 g/l.

In yet a preferred embodiment of the inventive method could also additional fresh steam be added into the withdrawal volume, adding an additional amount of steam for steaming the chips.

This solution is sometimes needed in mills located in colder climates, receiving chips at temperatures well below 0° C., which hence would require more steam for obtaining a full steaming effect at these extreme conditions. However, in many mills could this additional fresh steam be avoided.

In a further preferred embodiment of the inventive method could the impregnation fluid added to the impregnation vessel be obtained from a subsequent continuous digester from a withdrawal position in said digester located in the first half of the digester zone operated at full digester temperature.

In a further preferred embodiment of the inventive method could the additional fluid added to the withdrawal volume be obtained from a subsequent continuous digester from a withdrawal position located after the digester zone and preferably from a wash circulation at the bottom of the digester. By this usage of used cooking liquids from the digester could an additional recovery of heat energy be obtained also if the temperature in these liquid flows is lower than full cooking temperature.

The inventive system for impregnating and steaming chips in one single impregnation vessel during the manufacture of chemical pulp comprises following features. Said impregnation vessel having an inlet at the top for chips and an outlet in the bottom for impregnated chips. Further, said impregnation vessel having means for adding hot impregnation fluid at a first temperature above the boiling point of the hot impregnation fluid to the impregnation vessel, via a pipe having the outlet end located below a chip level (CH_LEV) established in the impregnation vessel and at a distance from the walls of the impregnation vessel. Said outlet preferably located in the centre, such that steam is released into the chip volume for steaming the chips. Said impregnation vessel further having means for establishing a fluid level by the added impregnation fluid in the impregnation vessel, and further having means for establishing a chip level lying at least 1-2 meters, preferably 3-5 meters, over the fluid level. The impregnation vessel further includes means for establishment of a pressure at the top of the impregnation vessel that is essentially at the level of atmospheric pressure, ±0.5 bar preferably ±0.2 bar, said impregnation vessel having a withdrawal screen section at the level of the fluid level comprising a withdrawal volume located behind screens mounted in the wall of the digester for withdrawing spent impregnation fluid (REC). According to the inventive design of the impregnation vessel the withdrawal volume is located at the level of the fluid level such that an upper part of the withdrawal volume is above the fluid level and the lower part is below the fluid level. One withdrawal pipe is connected to said withdrawal volume below the fluid level with means for withdrawing liquid from the withdrawal volume. Further, at least one feed pipe for adding an additional fluid at a second temperature above the boiling point of the additional fluid, said feed pipe connected to the withdrawal volume above the fluid level. The withdrawal volume is used as a flash volume for the additional fluid for releasing steam into the withdrawal volume, which steam is lead in towards the chips below the chip level for steaming the chips via a steam duct from said withdrawal volume. By this inventive design is the withdrawal volume exposed to increased flow velocity in the standing liquid volume behind the screen, and the withdrawal volume is also used as an active flash tank releasing steam to the chip volume located above the liquid level The inventive system could also further be equipped with at least one additional feed pipe for fresh steam connected to the withdrawal volume above the fluid level via a control valve. By this complementary design could additional fresh steam be added to the steam released from the additional fluid, which could be of use in some specific conditions such as during cold season and chips with a very low temperature.

In a preferred embodiment of the system could the steam duct be built as a labyrinth passage with a first vertical duct part connected at its upper end to a second vertical duct part having an outlet at its lower end into the chip volume directed downwardly. This will also provide for an unrestricted outlet for steam not being vulnerable for chip plugging.

In an alternative embodiment of the system could the steam duct be built as a piping system with at least one pipe connected at one end to the upper part of the withdrawal volume and at the other end connected to the wall of the impregnation vessel.

In yet a preferred embodiment of the system could the feed pipe for adding an additional fluid be arranged in a horizontal plane and connected tangentially to the withdrawal volume, thus ejecting the additional fluid into the withdrawal volume as a horizontal swirl flow. This will improve separation of the pressure reduced liquid part and the flashed off steam from the additional fluid.

In a further preferred embodiment of the system could the additional fluid added be led in piping directly and without any passage of any coolers from a subsequent continuous digester from a withdrawal position located after the digester zone and preferably from a wash circulation at the bottom of the digester, thus utilising the entire residual heat value of the wash liquid withdrawn from the digester.

The method and system use an inventive withdrawal screen section for use in pre-treatment of chips in a liquor-vapour phase treatment vessel having a vapour phase in the top and a liquid phase in the bottom of said vessel. In prior art withdrawal screens comprises;

- a screen mounted in the wall of the treatment vessel and in contact with chips drenched in treatment liquid inside the treatment vessel,
- a withdrawal volume arranged outside of the screen collecting treatment liquid withdrawn from the treatment vessel via said screen,
- a withdrawal pipe connected to the withdrawal volume for extracting spent treatment liquid.

According the inventive withdrawal screen it is modified such that it also comprises;

- said withdrawal volume having an upper vapour volume (60*a*) and a lower liquid volume,
- and an additional liquid pipe connected between a warm liquid source and the upper part of the withdrawal volume for supply of warm liquid into said withdrawal volume, as well as
- a steam duct connected between the upper part of the withdrawal volume and the vapour phase of the treatment vessel.

In essence, the design of the withdrawal volume as a flash tank and integration of steam ducting from the flash volume is a hereto new design.

The withdrawal screen section could preferably also be designed such that the steam duct is built as a labyrinth passage with a first vertical duct part connected at its upper end to a second vertical duct part having an outlet at its lower end into the chip volume directed downwardly.

Further, the withdrawal screen section could preferably also be designed such that the liquid pipe is arranged in a horizontal plane and connected tangentially to the withdrawal volume, thus ejecting the additional fluid into the withdrawal volume as a horizontal swirl flow.

DETAILED DESCRIPTION OF THE INVENTION

Definitions

The concept "untreated chips" will be used in the following detailed description. "Untreated chips" is here used to denote chips that have not passed through any form of steam treatment or similar, before the chips are fed into an impregnation vessel to be impregnated.

The concepts "fluid level/$LIQ_{LEV}$" and "chips level/$CH_{LEV}$" will also be used. The term "fluid level/$LIQ_{LEV}$" is here used to denote the level that the impregnation fluid added to the impregnation vessel 3 has established in the vessel. The term "chips level/$CH_{LEV}$" is here used to denote the height of that part of the bed of chips (consisting of chips) that is located above the fluid level, $LIQ_{LEV}$.

PRIOR ART SYSTEM, STARTING POINT FOR INVENTION

Figure 1:
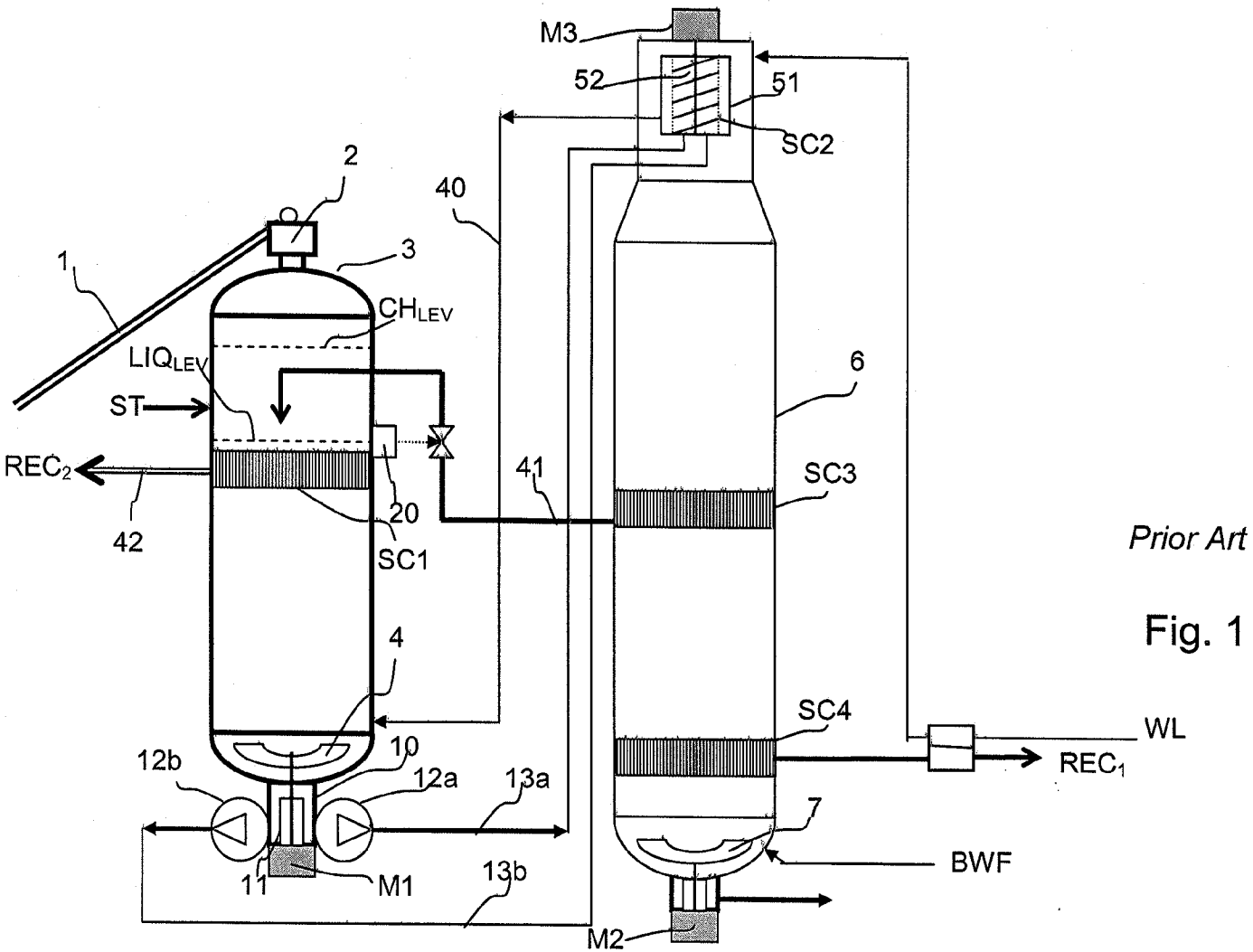
Prior Art Fig. 1
FIG. 1 shows a prior art 2-vessel continuous cooking system with a first atmospheric impregnation vessel.

FIG. 1 shows an arrangement known per se for the impregnation of chips during the manufacture of chemical pulp. The arrangement comprises an essentially cylindrical impregnation vessel 3 arranged vertically, to which non-steamed chips are continuously fed to the top of the impregnation vessel through a feed arrangement, in the form of a conveyor belt 1, and a sluice feed/chip feed 2. When operating the impregnation vessel in the "cold top" mode the temperature at the top of the vessel 3 would essentially corresponds to ambient temperature, 15-25° C. Additional fresh steam ST may be added if the ambient temperature falls below normal ambient temperature and in such a quantity that a chip temperature within this interval is established. The chips that are fed to the impregnation vessel normally maintain the same temperature as the ambient air temperature±5° C. The chips fed in establish a chips level $CH_{LEV}$ in the upper part of the impregnation vessel.

A feed line 41 with hot impregnation fluid BL is connected to the impregnation vessel in order to establish a fluid level, $LIQ_{LEV}$, consisting of the said impregnation fluid and controlled by level sensor 20 and associated valve in feed line 41. The impregnation fluid is fed in directly in association with the fluid level, $LIQ_{LEV}$, ±1 meter. The impregnation fluid BL is added at a distance from the wall of the impregnation vessel 3, and preferably at the centre of the impregnation vessel. The impregnation fluid BL is fed in to the impregnation vessel in such an amount and at such a temperature that the temperature at the fluid level, $CH_{LEV}$, is established within the interval 90-115° C. and preferably within the interval 95-105° C., whereby evaporation of fluid takes place up into the bed of chips lying above the fluid level, while at the same time steam is not driven through the bed of chips if operating in the cold top mode. The evaporation up into the bed of chips takes place over a distance that preferably does not exceed half of the height of the chips level, $CH_{LEV}$.

The impregnation fluid BL added is constituted to more than 50% by hot cooking fluid withdrawn from a screen SC3 after use in a cooking zone in a subsequent digester 6, which impregnation fluid BL has an alkali level of at least 15 g/l. The amount of impregnation fluid BL that is added to the vessel 3 lies between 5-10 $m^3$/ADT, preferably between 7-9 $m^3$/ADT, where "ADT" is an abbreviation for "Air-dry tonne" of pulp.

The temperature of the impregnation fluid BL in the feed line 41 maintains a temperature of 115-150° C. and the chips level $CH_{LEV}$ lies at least 1-2 meters over the fluid level and preferably 3-5 meters over the fluid level $LIQ_{LEV}$, in order to facilitate drenching of the chips down into the impregnation fluid, where the chips are thoroughly impregnated. The weight from the chip volume above the fluid level assists in drenching the chips even if some residual air may be caught in the chips.

Given non-steam treated chips that maintain 25° C. with their naturally occurring moisture level, 5 tonnes of fluid that maintains 139° C. are required in order to establish a temperature of approximately 115° C. in the chips mixture at the fluid level.

If a temperature of 100° C. is to be established in the chips mixture, given the same basic conditions, 5 tonnes of impregnation fluid that maintains 120° C. is required.

By adding the hot impregnation fluid in association with the fluid level $CH_{LEV}$, most if not all the air present in the chips will be flashed out, and the chips will sink in the impregnation fluid.

A line 42 withdraws spent impregnation fluid and steam condensate, i.e. $REC_2$, from withdrawal screen SC1 in the impregnation vessel 3, at the level of the fluid level $LIQ_{LEV}$.

The pressure in the vessel can be adjusted as required through a regulator valve arranged in a ventilation line (not shown) at the top of the impregnation vessel. The ventilation line may open directly into the atmosphere, for the establishment of atmospheric pressure. It is preferable that a pressure at a level of atmospheric pressure is established, or a slight negative pressure down to −0.2 bar (−20 kPa), or a slight excess pressure up to 0.2 bar (20 kPa). If necessary, an addition of a ventilating flow (sweep air) may be added at the top, which ventilating flow ensures the removal of any gases. However, this is not to be normally necessary during established operation.

The impregnated chips are continuously fed out through output means, here in the form of an outlet with two pumps 12*a* and 12*b*, combined where relevant with a bottom scraper 4, at the bottom of the impregnation vessel 101. The impregnated chips are thereafter fed to a top separator 51 arranged in the top of a continuous digester vessel 6. The top separator 51 is here shown as an inverted top separator comprising an upwardly feeding screw 52 that feed the chip slurry passed a top separator screen SC2, withdrawing excess impregnation liquid. The drained chips thereafter falls down into the digester vessel 6 and new fresh cooking WL liquor is added. Full cooking temperature is established in the digester either by adding steam or using heating circulations (not shown). According to established practice is most of the fresh cooking WL added to the digester, i.e. 50% or more, and in this example shown as a charge to the top of the digester. As full cooking temperature is established in the cooking zone is the alkali consumption rather high in first stages of delignification, but slows down in bulk and residual delignification stages. As indicated in previous parts is a hot cooking liquor with a substantial residual alkali level withdrawn via screen SC3 and used as the hot impregnation liquid in the impregnation vessel. This position is typically in first half part of the cooking zone or at the end of this part. Here the delignification process has slowed down after the first cooking stage where alkali consumption is high. Thus, for subsequent delignification stages the need for residual alkali is substantially lower than first cooking stage.

In a conventional manner is the cook in the digester 6 ended by a wash zone, comprising dilution nozzles DL for adding wash liquid, typically brown wash filtrate BWF, and a withdrawal screen SC4, where the added wash liquid will displace the hot spent cooking liquor in flow $REC_1$. As colder wash liquid is used, typically brown wash filtrate holds a temperature of 70-100° C., is the withdrawn hot spent cooking liquor $REC_1$ holding a temperature somewhat lower than full cooking temperature, but still with a residual heat content. As shown in FIG. 1 is this residual heat content utilised to heat the fresh cooking liquor WL in a heat exchanger, but after passage of such heat exchanger could the temperature still be well above 100° C.

The Invention

Figure 2:
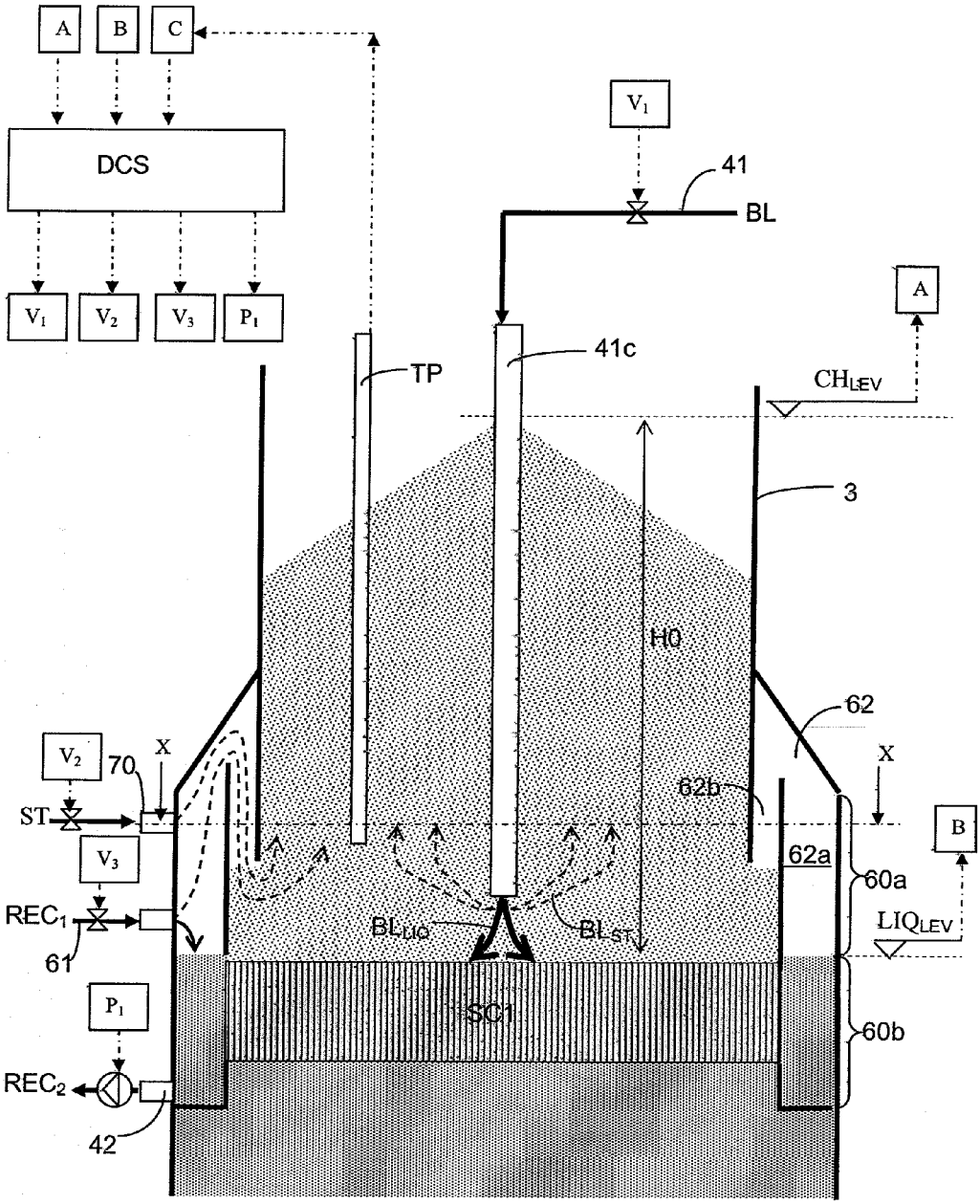
FIG. 2 shows a withdrawal screen section in the atmospheric impregnation vessel according to the invention.

FIG. 2 shows an inventive design of the withdrawal screen SC1 as implemented in a system shown in FIG. 1. Thus, other common features are not described if already described in connection with FIG. 1. Here is shown a vertical cross section of the impregnation vessel 3, with the established liquid level, $LIQ_{LEV}$, and the chip level, $CH_{LEV}$, forming a chip volume with height HO above the liquid level. The control means for maintaining set levels use a conventional Digital Control System, DCS, receiving sensor inputs from level sensors A and B respectively as well as a temperature measuring pole TP, controlling in- and outflow of chips, as well as steam and added liquids. As shown here is the hot impregnation liquid added via a central pipe 41*c*, and steam flash out from the hot liquor as it leaves the outlet of the central pipe. According the invention is the withdrawal volume 50 located at the level of the fluid level, $LIQ_{LEV}$, such that an upper part 50*a* of the withdrawal volume is above the fluid level and the lower part

50*b* is below the fluid level. At least one withdrawal pipe 42 is connected to said withdrawal volume below the fluid level with means, here shown as a pump, for withdrawing liquid from the withdrawal volume. Also, at least one feed pipe 51 for adding an additional fluid $REC_1$ at a second temperature above the boiling point of the additional fluid. Said feed pipe 51 connected to the withdrawal volume above the fluid level, whereby the upper part 50*a* of the withdrawal volume 50 is used as a flash volume for the additional fluid $REC_1$ for releasing steam into the withdrawal volume, which steam is lead in towards the chips below the chip level for steaming the chips via a steam duct 52 from said withdrawal volume 50.

Further, at least one additional feed pipe 70 for fresh steam is preferably connected to the upper part 60*a* of the withdrawal volume 60 above the fluid level via a control valve.

In the embodiment shown in FIG. 2 is the steam duct 62 built as a labyrinth passage with a first vertical duct part 62*a* connected at its upper end to a second vertical duct part 62*b* having an outlet at its lower end into the chip volume directed downwardly.

Figure 5:
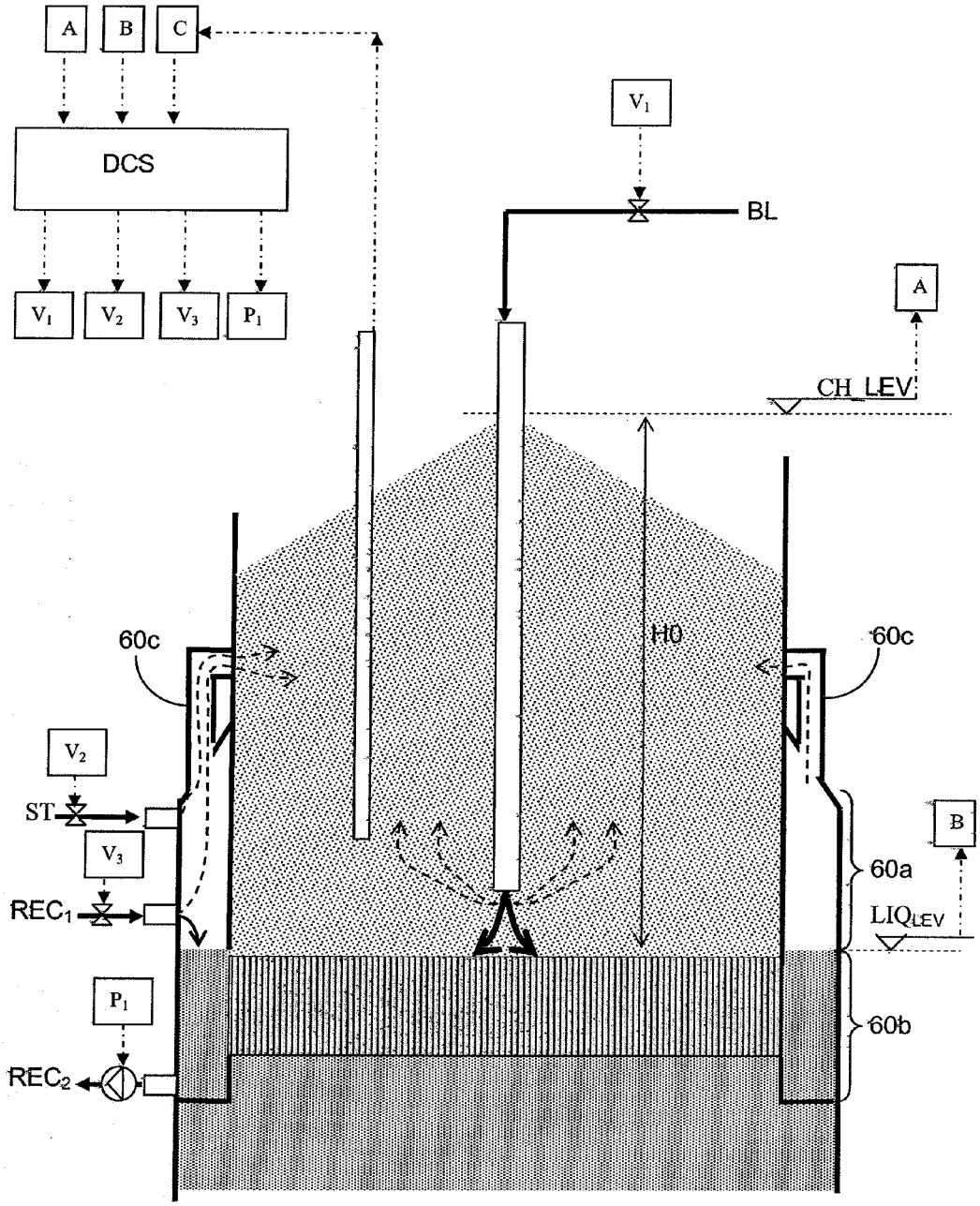
FIG. 5 shows an alternative embodiment of FIG. 2.

As shown in FIG. 5 could the steam duct be designed using at least one and preferably a number of steam pipes 60*c* connected to the upper part 60*a* of the withdrawal volume 60*a*. The steam pipe 60*c* is thus connected at one end to the upper part 60*a* of the withdrawal volume and at the other end connected to the wall of the impregnation vessel, preferably via some screen diffuser (not shown) preventing chips from clogging the pipe outlet.

Figure 3:
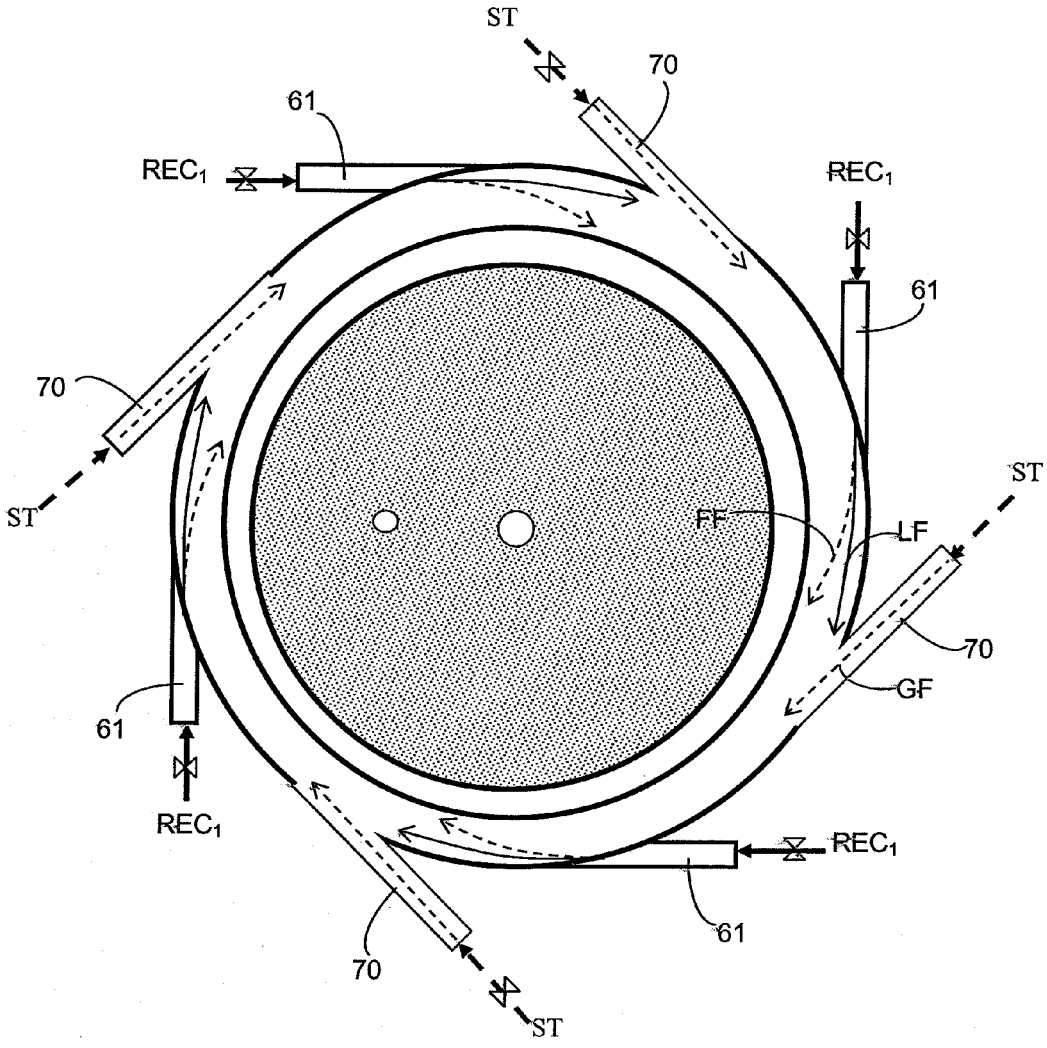
FIG. 3 shows a 2-vessel continuous cooking system using the inventive withdrawal screen section.

In FIG. 3 is shown a view from above in section X-X of FIG. 2. As shown here are at least 4 feed pipes 61 for adding an additional fluid $REC_1$ arranged in a horizontal plane and connected tangentially to the upper part 60*a* of the withdrawal volume, thus ejecting the additional fluid into the withdrawal volume as a horizontal swirl flow. As indicated is steam FF flashed off from the remaining liquid flow LF. The same design could also be used for the pipes for fresh steam ST, and preferably connected to the wall at intermediate positions between neighbouring pipes 61, but situated at a higher position as shown in FIG. 2.

Figure 4:
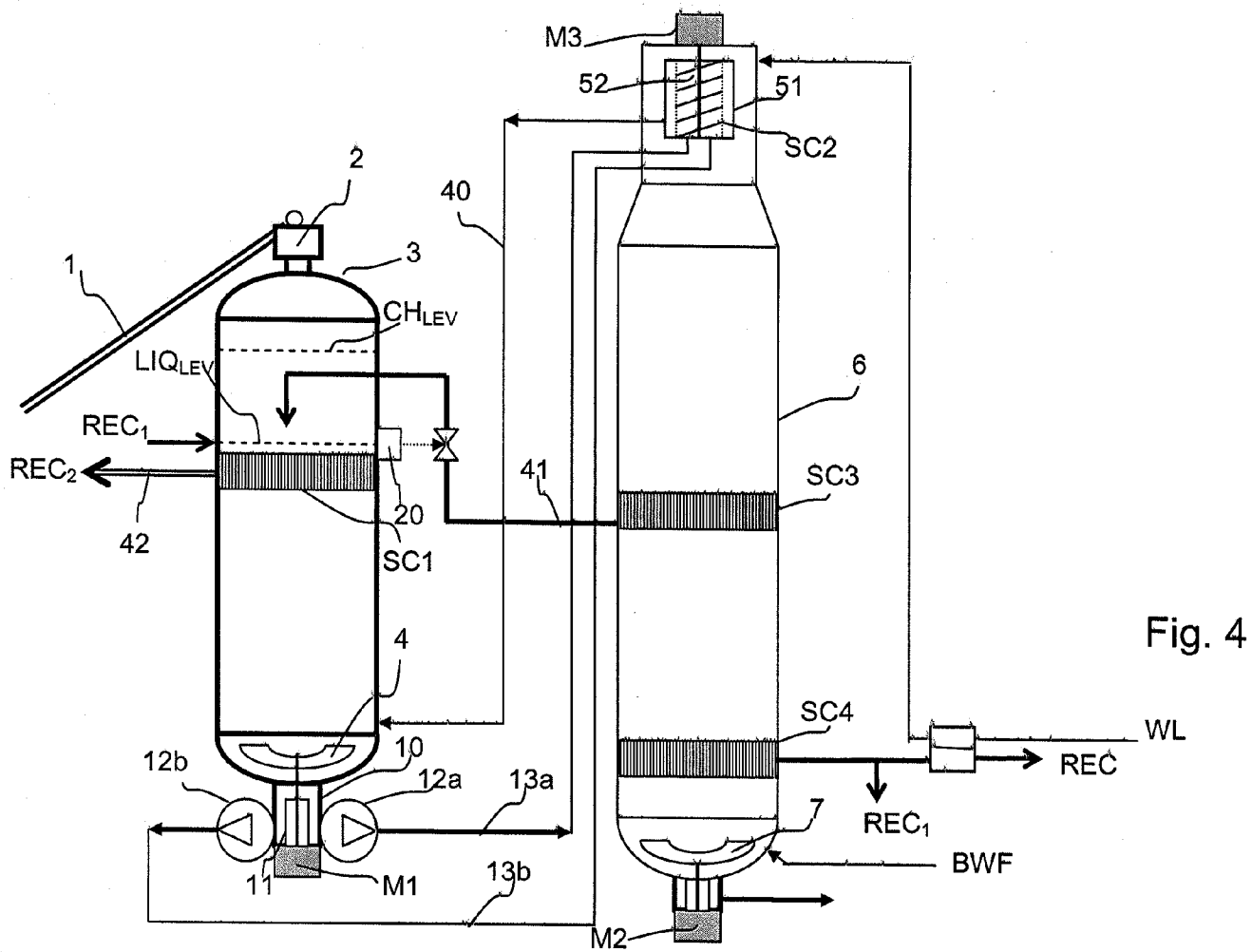
FIG. 4 shows the withdrawal screen section in a view from above in section A-A in FIG. 2.

In FIG. 4 is shown what liquid in the digester system is used as the additional fluid added to the withdrawal volume 60. Here is the additional fluid $REC_1$ led in piping directly and without any passage of any coolers from a subsequent continuous digester from a withdrawal position, from screen SC4, located after the digester zone and preferably from a wash circulation at the bottom of the digester, thus utilising the total residual heat value of the wash liquid withdrawn from the digester. Even after passage of the white liquor heat exchanger there is a residual heat value left that could be used, and also liquor having passed a heat exchanger could be used at least in part of the total volume of additional fluid flashed in the withdrawal volume 60.

The invention is not limited to the embodiments shown. Several variants are possible within the framework of the claims.

Exemplary Embodiment

In a digester system similar to FIG. 1 and having a production capacity of about 2000 ton of pulp per day, was a withdrawal flow of 191 ton/h obtained from the upper withdrawal section in the impregnation vessel, similar to SC1 in FIG. 1. A warm pressurized additional fluid, similar to $REC_1$, was obtained from the wash circulation and was added in volumes of 570 ton/h into the withdrawal volume such that steam flashed off and a temperature drop of 9° C. was experienced in the added fluid. This produced an additional steam volume of 9, 1 ton/h capable of increasing the temperature of the chips some 25° C., and an added liquid volume of 561 ton/h into the withdrawal volume.

$$Q_{Added\ pressurized\ warm\ liquid}=Q_{steam}+Q_{liquid}.$$

This also resulted in an increased flow velocity behind screen from 191 ton/h to 742 ton/h (191+561), which increased the flow velocity about 4 times. These positive effects were obtained with the only additional cost of increased power consumption for the pump evacuating the liquid from the withdrawal volume.

While the present invention has been described in accordance with preferred compositions and embodiments, it is to be understood that certain substitutions and alterations may be made thereto without departing from the spirit and scope of the following claims.

The invention claimed is:

1. A method for the impregnation of chips during the manufacture of chemical pulp, comprising;

continuously feeding chips without preceding steam treatment to a top of an impregnation vessel, feeding out impregnated chips from a bottom of the impregnation vessel, adding hot impregnation fluid (BL), at a first temperature above a boiling point of the hot impregnation fluid, to the impregnation vessel, via a pipe having an outlet end located below a chip level (CHLEV) established in the impregnation vessel and at a distance from walls of the impregnation vessel, the hot impregnation fluid (BL) releasing steam into a chip volume for steaming the chips, the added impregnation fluid (BL) establishing a fluid level (LIQLEV) in the impregnation vessel, the chip level (CHLEV) being above the fluid level and the top of the impregnation vessel having a pressure that is essentially at atmospheric pressure, withdrawing spent impregnation fluid (REC), at the fluid level (LIQLEV), from a withdrawal volume located behind screens mounted in a wall of the impregnation vessel, adding an additional fluid (REC1) at a second temperature above the boiling point of the additional fluid into the withdrawal volume, the additional fluid releasing steam into the withdrawal volume, and leading the steam towards the chips below the chip level (CHLEV) for steaming the chips.

2. The method according to claim 1, wherein the method further comprises establishing a temperature of a fluid-wood mixture that is established at the fluid level (LIQLEV) within the interval 90-115° C.

3. The method according to claim 2, wherein the method further comprises setting a temperature of the additional fluid (REC1) fed into the withdrawal volume behind the screens in the impregnation vessel to exceed a boiling point of the additional fluid in the withdrawal volume by at least 5° C.

4. The method according to claim 3, wherein additional fresh steam (ST) is added into the withdrawal volume.

5. The method according to claim 4, wherein the impregnation fluid (BL) added to the impregnation vessel is obtained from a subsequent continuous digester from a withdrawal position in the digester located in a first half of a digester zone operated at full digester temperature.

6. The method according to claim 3, wherein the additional fluid (REC1) added is obtained from a withdrawal position located after a digester zone of a subsequent continuous digester.

7. The method of claim 1 wherein the method further comprises providing the hot impregnation fluid (BL) with an alkali level that exceeds 15 g/l.

8. The method of claim 1 wherein the method further comprises providing the additional fluid (REC1) with an alkali level that exceeds 2 g/l.

* * * * *